United States Patent [19]

vander Werff

[11] 4,120,409

[45] Oct. 17, 1978

[54] HOPPER BARGE HAVING A BOTTOM DISCHARGE OPENING CLOSABLE BY HOPPER DOORS

[75] Inventor: Bartele vander Werff, Medemblik, Netherlands

[73] Assignee: A. Vuyk & Zonen's Scheepswerven B.V., aan de IJssel, Netherlands

[21] Appl. No.: 769,712

[22] Filed: Feb. 17, 1977

[30] Foreign Application Priority Data

Feb. 23, 1976 [NL] Netherlands ..... 7601808

[51] Int. Cl.[2] ..... B67D 3/00

[52] U.S. Cl. ..... 214/15 R; 105/240; 114/36; 222/504

[58] Field of Search ..... 214/12, 15 R, 15 B; 298/29-37; 105/240, 282 A; 114/27, 36, 37; 222/504, 512

[56] References Cited

U.S. PATENT DOCUMENTS

| | | | |
|---|---|---|---|
| 1,255,383 | 2/1918 | Burris | 298/34 |
| 2,989,008 | 6/1961 | Lindstrom | 222/512 X |
| 3,578,222 | 5/1971 | Pot | 114/36 X |
| 3,626,866 | 12/1971 | Fritz | 222/512 X |
| 3,834,595 | 9/1974 | Brock et al. | 222/504 |

*Primary Examiner*—Frank E. Werner

*Attorney, Agent, or Firm*—Haseltine, Lake & Waters

[57] ABSTRACT

Hopper barge comprising a hopper having at least one center keelson box and at least one bottom discharge opening closable by at least one swivelling hopper door, as well as a control mechanism for the hopper door, wherein along the longitudinal edge of the bottom discharge opening cooperating with the free swivel edge of a hopper door there is provided a passage which can be made to communicate throughout its length with the interior of the hopper, and the control mechanism can place the hopper door in a fully opened position, thus clearing the bottom discharge opening, in a central position, in which the bottom discharge opening is closed and the connection between the hopper and the passage is cleared, and in a fully closed position, in which both the bottom discharge opening and the connection between the hopper and the passage are closed.

5 Claims, 3 Drawing Figures

HOPPER BARGE HAVING A BOTTOM DISCHARGE OPENING CLOSABLE BY HOPPER DOORS

FIELD OF THE INVENTION

The present invention relates to a hopper barge comprising a hopper having at least one centre keelson box and at least one bottom discharge opening closable by at least one swivelling hopper door, as well as a control mechanism for the hopper door.

PRIOR ART

This type of hopper barges is generally known. The discharge of the load accommodated in the hopper of such a barge is effected by opening the hopper doors by means of the control mechanism, so that the load can slip out of the hopper. However, in case such a hopper is to be sucked empty, that is, is to be discharged again as it were through the filling opening of the hopper, this is only possible with difficulty and with expensive, additional equipment. Besides this equipment constitutes additional obstacles in the hopper which can hamper rapid and complete discharge considerably.

SUMMARY OF THE INVENTION

An object of the invention is to provide a hopper construction which eliminates this problem in a simple but effective way.

This is achieved, according to the invention, in a hopper of the type described above in that along the longitudinal edge of the bottom discharge opening cooperating with the free swivel edge of a hopper door there is provided a passage communicating throughout its length with the interior of the hopper. Through this passage, which extends throughout the hopper, the hopper can be sucked empty in a simple manner. It is preferred that the connection between the passage and the interior of the hopper is closable by the hopper door, so that during loading and transport the hopper is fully closed at least at the bottom.

In accordance with a preferred embodiment, the hopper according to the invention is so constructed that the control mechanism can place the hopper door in a fully opened position, thus clearing the bottom discharge opening, in a central position, in which the bottom discharge opening is closed and the connection between the hopper and the passage is cleared, and in a fully closed position, in which both the bottom discharge opening and the connection between the hopper and the passage are closed. Owing to this control of positions the possibility of choosing a certain discharging method is advantageously created. Preferably the control mechanism has to overcome an additional resistance for pulling the hopper door from the central position to the fully opened position, the resistance being formed, for instance, by a bend in the guide for the swivel edge of the hopper door, or by an additional piston resistance if the control mechanism includes a piston, so that it is clearly visible when during opening of the swivelling hopper doors these doors have reached the position in which the hopper can be optimally sucked empty and after which the bottom discharge opening will be cleared.

To use the sucking passage as effectively as possible it is preferred, in accordance with a further preferred embodiment of the invention, that the hopper door is so inclined in the central position as to form a guideway in the direction of the passage. Besides the fact that the passage is located substantially at the lowest point it is also ensured that an optimal supply to the passage is effected.

If the hopper door can be continuously adjusted and stopped between the fully closed position and the central position, an effective and simple metering possibility is moreover obtained during discharge. It should be borne in mind that a hopper is usually subdivided by bulkheads, each hopper portion having two hopper doors. With the proposed metering possibility such a hopper can be discharged in any desired way.

BRIEF DESCRIPTION OF THE DRAWINGS

The hopper according to the invention will now be described in more detail with reference to the drawings showing one embodiment by way of example.

DETAILED DESCRIPTION

Figure 1:
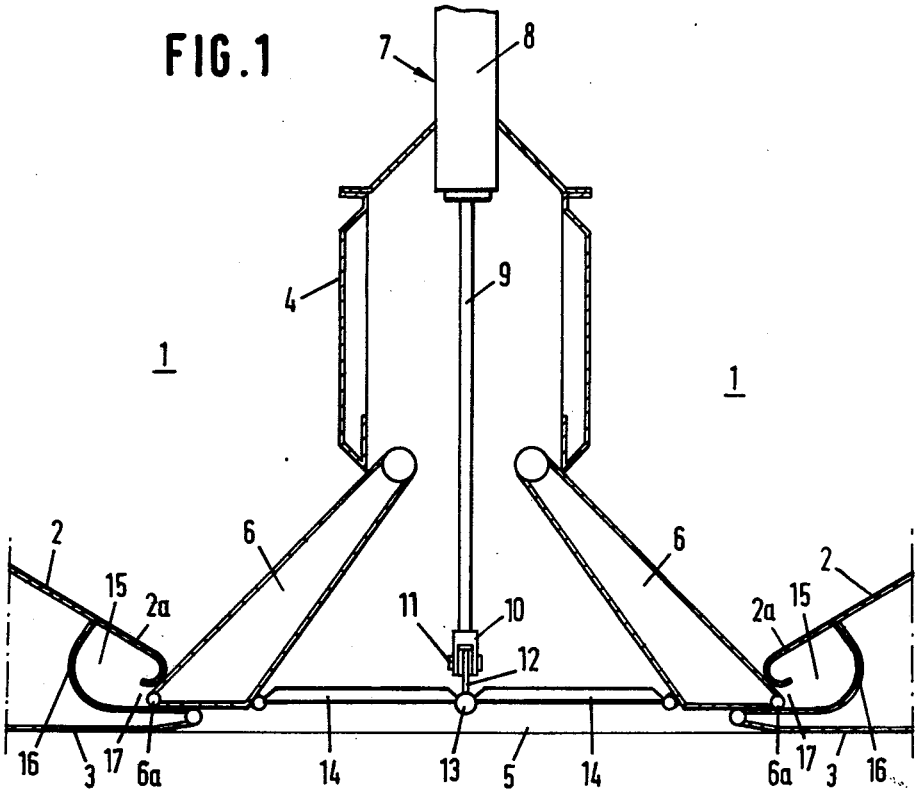
FIG. 1 is a cross-sectional view of the bottom discharge opening of the hopper with the passage according to the invention, in which the hopper doors are in the fully closed position.
Figure 2:
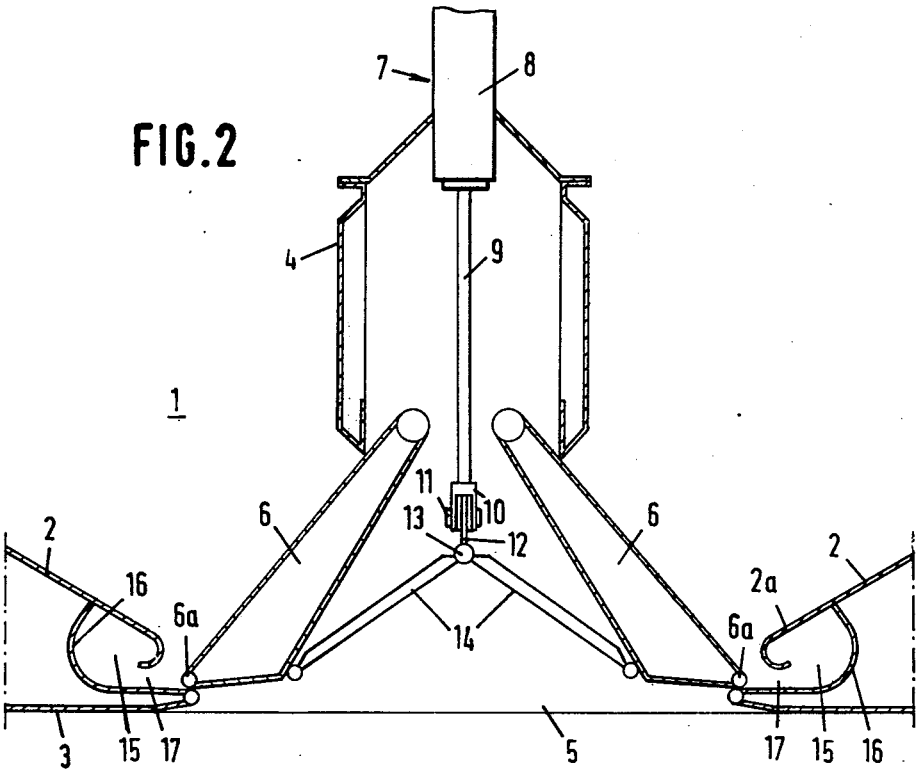
FIG. 2 is the sectional view of FIG. 1 with the hopper doors in the central position.
Figure 3:
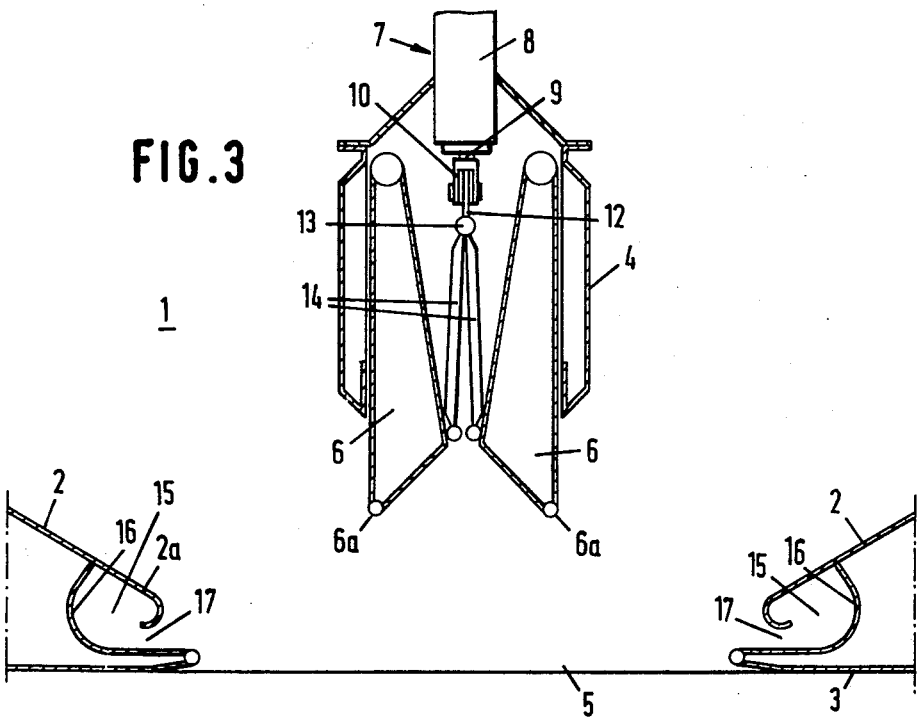
FIG. 3 is the sectional view shown in FIG. 1 with the hopper doors in the fully opened position.

In FIGS. 1, 2 and 3, reference numeral 1 indicates the hopper space, 2 the bottom wall of the hold and 3 the bottom of the hopper itself. In hopper 1 is located a centre keelson box 4 extending longitudinally of the hopper, and centrally positioned above bottom discharge opening 5. Bottom discharge opening 5 can be closed by means of two swivelling hopper doors 6, which are controlled by a central control mechanism 7, including a hydraulic cylinder 8 with piston rod 9. At the free end of piston rod 9 is provided a crosshead 10 having bores for receiving a shaft 11. Shaft 11 includes a hinged portion 12 to which a shaft 13 is attached. Hopper doors 6 are connected to shaft 13 via door support means 14 with double pivots, i.e. both adjacent the connection between hopper door 6 and door support means 14 and that between door support means 14 and shaft 13. Door support means 14 can be both rod-shaped and plate-shaped and are connectable to hopper doors 6 in any suitable or desired position. Additionally, the control mechanism can also be controlled pneumatically or mechanically, for example with a rack and pinion transmission. The two ends of shaft 13 are preferably positioned in a vertical guideway to ensure correct functioning of the doors.

In the longitudinal edges of bottom discharge opening 5 there is formed a passage 15 by the J-shaped end **2*a* of the hopper bottom wall 2 on the one hand and a J-shaped plate 16 on the other. Passage 15 doesn't have a continuously closed construction as seen in cross-section, but has an opening 17 which can be closed by door edge 6*a***.

Each of doors 6 comprises a set of lateral journals **6*b*, which are bearing-mounted for swivelling and/or sliding movement in centre keelson box 4. The construction is preferably such that doors 6 can entirely or almost entirely be withdrawn into centre keelson box 4 by control mechanism 7. Doors 6 can further be provided adjacent their edges 6*a* with additional lateral support and guide journals. The seals between the doors and the relevant hopper parts can be effected with rigid rubber slabs and rubber pads. To increase the floating power an air cushion can be formed in the space defined by centre keelson box 4, hopper doors 6 and door support means 14**.

The operation of the apparatus will now be elucidated with reference to FIGS. 1, 2 and 3. In FIG. 1 hopper doors 6 are in the fully closed position, which means that hopper 1 is fully closed with respect to entrance 17 to passage 15 as well as bottom discharge opening 5. This is the position which doors 6 can take during loading of the hopper and transport of the load taken.

Discharge of the load must be possible in two ways; on the one hand by sucking the hopper empty, the load being discharged at a given place adjacent the hopper, on the other hand by dumping the load directly under the hopper.

If the hopper is to be sucked empty, control mechanism 7 is actuated in such a manner that the hopper doors take the central position shown in FIG. 2. The opening 17 is cleared, thus forming a connection between hopper 1 and passage 15. One or both ends of each passage 15 can be connected to a discharge line through which hopper 1 can be sucked empty, for instance by means of a pump. With the control mechanism the position of the doors and hence the quantity of sucked-away load can be controlled. If the hopper is subdivided by bulkheads into a number of compartments each closable at the bottom by a pair of hopper doors with control mechanism, passages 15 extend preferably uninterruptedly throughout the length of the hopper. As a result, the possibility has been created, together with the variable control of the doors and the mutually independent control of the pairs of doors, to empty the hopper compartment by compartment, all compartments at the same time to the same extent or according to any other desired variation.

If the hopper is to be emptied, hopper doors 6 are pulled upwardly into centre keelson box 4 by control mechanism 7, as shown in FIG. 3. Bottom discharge opening 5 is then cleared optimally, thus permitting the load to slip out of the hopper through bottom discharge opening 5 without any obstruction.

In order to prevent the hopper doors 6 from being drawn through the central position unintendedly, resulting in at least partial clearing of the bottom discharge opening, it is preferred to build in an additional resistance at this point. This can be done by arranging a bend in the guide of the doors. In the construction shown in the drawings this is possible in a simple manner, as the door edge 6*a* must be guided rectilinearly from the fully closed position to the central position and afterwards traverses a bent curve. As the two guides are contiguous to one another in the central position, it is not difficult to make a bend there, neither from a manufacturing, nor from a designing viewpoint. Door 6 can be guided by sliding its leading edge over plate 16 from the fully closed position to the central position and from the central position to the fully opened position by journals arranged adjacent the leading edge, which are guided in guideways attached to the hopper or compartment bulkheads. The additional resistance to be overcome can also be built in the hydraulic cylinder or otherwise, of course.

Moreover, by arranging the doors slantingly in the central position, as shown in the drawing, a particularly effective guide in the direction of passage 15 is obtained, which passage is moreover adjacent the lowest point of the hopper.

It will be clear that the invention is not limited to the embodiment described above and shown in the drawings but that a great many variants are possible without departing from the scope of the present invention. For instance, solely swivelling hopper doors can be used, in which case the guide portion of plate 16 must have a corresponding form of an arc of a circle. Furthermore the construction can also be used in a single bottom discharge door for closing the bottom discharge opening.

I claim:

1. A hopper barge comprising a hopper including inclined side walls and having a discharge opening, a central keelson box disposed above said opening, suction passage means extending along said discharge opening adjacent one of said side walls, at least one hopper door, control means coupled to said door for moving the door pivotably and in translation between a first position in which said discharge opening is closed and said passage means is blocked, a second position in which the discharge opening is fully open and the door is substantially retracted into the keelson box, and a third position intermediate the first and second positions in which the discharge opening is closed and said passage means is open.

2. A hopper barge according to claim 1, wherein: said control means being defined to overcome resistive forces developed in urging the hopper door from the third position to the fully opened second position.

3. A hopper barge according to claim 2, wherein: said resistive forces being developed by a bend in a guide associated with a swivel edge of the hopper door.

4. A hopper barge according to claim 1, wherein: the hopper door being inclined in said third position to thereby form a guideway in the direction of the passage means.

5. A hopper barge according to claim 1, wherein; said control means being adapted to enable continuous control and positioning of said hopper door between the fully closed first position and the third position.

* * * * *